US011832051B2

(12) United States Patent
Hafizovic et al.

(10) Patent No.: US 11,832,051 B2
(45) Date of Patent: Nov. 28, 2023

(54) MICROPHONE ARRAYS

(71) Applicant: Squarehead Technology AS, Nydalen (NO)

(72) Inventors: Ines Hafizovic, Nydalen (NO); Trond Berg, Nydalen (NO); Stig Nyvold, Nydalen (NO)

(73) Assignee: SQUAREHEAD TECHNOLOGY AS, Oslo (NO)

( * ) Notice: Subject to any disclaimer, the term of this patent is extended or adjusted under 35 U.S.C. 154(b) by 0 days.

(21) Appl. No.: 17/276,271

(22) PCT Filed: Sep. 13, 2019

(86) PCT No.: PCT/GB2019/052582
§ 371 (c)(1),
(2) Date: Mar. 15, 2021

(87) PCT Pub. No.: WO2020/053601
PCT Pub. Date: Mar. 19, 2020

(65) Prior Publication Data

US 2022/0060818 A1 Feb. 24, 2022

(30) Foreign Application Priority Data

Sep. 14, 2018 (GB) ..... 1814988

(51) Int. Cl.
*H04R 3/00* (2006.01)
*H04R 1/40* (2006.01)

(52) U.S. Cl.
CPC ..... *H04R 1/406* (2013.01); *H04R 3/005* (2013.01); *H04R 2201/401* (2013.01); *H04R 2201/405* (2013.01)

(58) Field of Classification Search
CPC ... H04R 1/406; H04R 3/005; H04R 2201/401
(Continued)

(56) References Cited

U.S. PATENT DOCUMENTS 7,133,530 B2 * 11/2006 Poletti ..... H04R 3/005 381/92
7,629,263 B2 * 12/2009 Seto ..... B81C 1/00182 257/E21.232

(Continued)

FOREIGN PATENT DOCUMENTS

| | | | |
|---|---|---|---|
| EP | 2941013 | A1 | 11/2015 |
| WO | 2004084577 | A1 | 9/2004 |
| WO | 2008040991 | A2 | 4/2008 |

OTHER PUBLICATIONS

Boaz Rafaely, Senior Member, IEEE; IEE Signal Processing Letters, vol. 12, No. 10, Oct. 2005; pp. 713-716; "Phase-Mode versus Delay-and-Sum Spherical Microphone Array Processing".

(Continued)

*Primary Examiner* — Disler Paul
(74) *Attorney, Agent, or Firm* — Taft Stettinius & Hollister LLP; Ryan O. White; Derek B. Lavender

(57) ABSTRACT

A system for capturing sound comprising a plurality of discrete microphones (112, 14, 116, 118) and a processing system (408). The plurality of discrete microphones are arranged in a circular array. The processing system (408) arranged to perform a first signal processing algorithm on sound originating from one or more of a first set of directions relative to the array to isolate a first sound source. The processing system (408) is further arranged to perform a second signal processing algorithm on sound originating from one or more of a second set of directions relative to the array to isolate a second sound source therein. A method for receiving sound at a plurality of discrete microphones (112, 114, 116, 118) arranged in a circular array is also described.

20 Claims, 11 Drawing Sheets

(58) Field of Classification Search
USPC ..... 381/91–92, 122, 56
See application file for complete search history.

(56) References Cited

U.S. PATENT DOCUMENTS

| | | | | |
|---|---|---|---|---|
| 9,202,475 | B2 * | 12/2015 | Elko | H04R 25/453 |
| 9,232,309 | B2 * | 1/2016 | Zheng | H04R 3/005 |
| 9,253,567 | B2 * | 2/2016 | Morcelli | H04R 3/005 |
| 9,980,042 | B1 * | 5/2018 | Benattar | H04R 25/407 |
| 10,264,351 | B2 * | 4/2019 | Choisel | H04R 1/403 |
| 10,310,082 | B2 * | 6/2019 | Bultan | G01S 15/04 |
| 10,366,700 | B2 * | 7/2019 | Marquez | G10L 21/0208 |
| 10,431,211 | B2 * | 10/2019 | Kim | G10L 21/028 |
| 10,536,681 | B2 * | 1/2020 | Sawa | H04R 1/08 |
| 10,602,265 | B2 * | 3/2020 | Xiang | G01S 3/8083 |
| 10,602,475 | B2 * | 3/2020 | Wei | H04W 88/14 |
| 10,631,085 | B2 * | 4/2020 | Kirkpatrick | H04R 3/005 |
| 10,657,981 | B1 * | 5/2020 | Mansour | H04R 3/005 |
| 10,681,457 | B2 * | 6/2020 | Secall | G01C 9/00 |
| RE48,402 | E * | 1/2021 | Mukund | H04S 3/006 |
| 11,095,978 | B2 * | 8/2021 | Gigandet | G10L 21/0216 |
| 11,120,813 | B2 * | 9/2021 | Shin | G10L 21/02 |
| 2012/0114128 | A1 | 5/2012 | Derkx | |
| 2012/0327115 | A1 | 12/2012 | Chhetri et al. | |
| 2018/0188347 | A1 | 7/2018 | Gao et al. | |
| 2019/0116444 | A1 * | 4/2019 | Benattar | H04S 7/303 |

OTHER PUBLICATIONS

S.C. Chan and Carson K.S. Pun; IEEE, Depailment of Electrical and Electronic Engineering; The University of Hong Kong, Pokfulam Road, HK; pp. 693-696; "On the Design of Digital Broadband Beamformer for Uniform Circular Array With Frequency Invariant Characteristics".

D.E.N. Davis, M.Sc., Ph D., Graduate I.E.E; Proc. IEE, vol. 112, No. 11, Nov. 1965; pp. 2041-2045; "A Transformation between the phasing techniques required for linear and circular aerial arrays".

Nes Hafizovic, Carl-Inge C. Nilsen, and Sverre Holm; Department of Informatics, University of Oslo, Norway; 2011 IEEE Workshop on Applications of Signal Processing to Audio and Acoustics; Oct. 16-19, 2011 pp. 233-236; "Decorrelation for Adaptive Beamforming Applied to Arbitrarily Sampled Spherical Microphone Arrays".

Xie Ju-Lan and He Zi-Shu; Dept, of Electronic Engineering, University of Electronics Science and Technology of China, Chengdu, Sichuan, China; Proceedings of 2007 International Symposium on Intelligent Signal Processing and Communication Systems, Nov. 28-Dec. 1, 2007 Xiamen, China; pp. 850-853; "Beamforming of Coherent Signals for Weighed Two Concentric Ring Arrays".

Jens Meyer, Gary Elko; mh acoustics 25A Summit Ave, Summit, NJ, USA, pp. 5280-5283; "Spherical Harmonic Modal Beamforming for an Augmented Circular Microphone Array".

Jens Meyer: Published by the Acoustical Society of America; The Journal of the Acoustical Society of America 109, 185 (2001); doi: 10.1121/1.1329616; https://doi.org/10.1121/1.1329616; pp. 185-193.

Harry L. Van Trees; "Optimum Array Processing" Part IV of Detection, Estimation and Modulation Theory; (PART A).

Harry L. Van Trees; "Optimum Array Processing" Part IV of Detection, Estimation and Modulation Theory (Part B).

T. Rahim, Ph.D., Mem.I.E.E.E. and Prof. D.E.N. Davis, D.Sc., F.Eng., F.I.E.R.E., F.I.E.E.; Department of Electronic and Electrical Engineering, University College London; Jul. 20, 1981; "Effect of directional elements on the directional response of circular antenna arrays"; pp. 18-22.

European Patent Office, From the International Searching Authority, ISR and WO of the ISA, or the Declaration; dated: Jan. 13, 2020; pp. 1-20.

EPO Official Letter for Application No. 19773150.8; dated Jan. 30, 2023; 6 Pages.

* cited by examiner

Phase Domain Beamforming

Azimuth

Elevation

Azimuth

Elevation

MICROPHONE ARRAYS

This application is a U.S. National Phase of International Application No. PCT/GB2019/052582 filed on Sep. 13, 2019, which claims the benefit of GB1814988.0 filed Sep. 14, 2018, the contents of which are herein incorporated by reference in entirety.

This invention relates to microphone arrays, particularly, although not exclusively, circular microphone arrays intended to capture sound from a wide range of different directions.

Sensor arrays are used in a large number of applications such as acoustic surveillance/detection, radar, sonar, ultrasound, and radio communication to name a few. One of the attractive features of sensor arrays is the ability to perform spatial filtering without mechanical adjustment, a process known as beamforming. The ability to vary the direction of maximum array response, known as steering, is limited by the geometry of the array. Arrays with rotationally symmetric manifolds (spherical, cylindrical and circular) are highly flexible with regard to beampattern design.

Processing with rotationally symmetric arrays is commonly done with a technique called phase mode processing as is seen in D.E.N. Davies "A transformation between the phasing techniques required for linear and circular aerial arrays", Proc. IEEE, vol. 112, no. 11, pg. 2041-2045, November 1965. The technique exploits the symmetry of the array by transforming the data from element space to a basis of rotationally symmetric functions ("phase modes"). It is common practice to transform the phase mode data further to allow for processing techniques specific to linear arrays as seen in Hafizovic et al "Decorrelation for adaptive beamforming applied to arbitrarily sampled spherical microphones arrays", IEEE Workshop on Applications of Signal Process. to Audio and Acoustic, October 2011, pg. 233-236. For circular arrays, one such transform of the phase mode data consists of applying a weighting such that the in-plane frequency-dependence of the phase mode array manifold vector is cancelled, a technique known as Frequency-Invariant Beamforming (FIB) as implemented by Chan et al in "On the design of a digital broadband beamformer for uniform circular array mounted on spherically shared objects", IEEE Int. Symp. on Circuits and Systems, 2002. Furthermore, the in-plane directivity with this weighting is optimal as shown by Ju-Ian et al in "Beamforming of coherent signals for weighted two concentric ring arrays", Int. Symp. on Intelligent Signal Process. and Communication Systems, November 2007, pg. 850-853.

However, the increased azimuthal directivity comes at a cost, as phase mode beamformers are known to have generally poor white noise gain (WNG) as highlighted in B. Rafaely "Phase-mode versus delay-and-sum spherical microphone array processing", IEEE Signal Process. Lett., vol. 12, no. 10, pg. 713-716, October 2005. Rahim et al in "Effect of directional elements on the directional response of circular antenna arrays", Proc. Inst. Elect. Eng., Part H: Microwaves, Optics, Antennas, vol. 129, no. 1, pg. 18-22, February 1982, demonstrates that circular arrays in particular have poor sidelobe control in the elevation direction result in poor 3D directivity. Rahim also suggests using directional elements mounted with their main response axis in the radial direction. Directive elements may be simulated by replacing the elements with linear apertures or small linear arrays perpendicular to the array plane as seen in Van Trees "Optimum array processing", ser. Detection, estimation, and modulation theory, John Wiley & Sons, 2004, no. IV. For acoustic arrays, a different approach is to mount the elements on a rigid baffle as seen in Meyer "Beamforming for a circular microphone array mounted on spherically shaped objects", J. Acoust. Soc. Amer., vol. 109, no. 1, pg. 185-193, January 2001. However, directional microphones are known to be poorly matched in general and require exact alignment (see Meyer et al "Spherical harmonic modal beamforming for an augmented circular microphone array", IEEE Int. Conf. on Acoust., Speech and Signal Process, March 2008, pg. 5280-5283), and using perpendicular apertures/arrays or baffles adds bulk and complexity to the array. Meyer also investigates the concept of using multi-ring arrays for acquisition of wideband signals.

The field of microphone arrays is therefore well developed but is still subject to a number of basic constraints. One of these that the Applicant has now appreciated is that high performance arrays are designed and optimized for particular applications which can make them cost-prohibitive for some uses.

The Applicant has made a number of developments with the intention of providing improvements in the performance of microphone arrays and when viewed from a first aspect the invention provides a method comprising:

- receiving sound at a plurality of discrete microphones arranged in a circular array, at least some of said microphones producing signals in response to said sound,
- performing a first signal processing algorithm on sound originating from one or more of a first set of directions relative to said array to isolate a first sound source therein; and
- performing a second signal processing algorithm on sound originating from one or more of a second set of directions relative to said array to isolate a second sound source therein.

This aspect of the invention extends to a system for capturing sound comprising:

- a plurality of discrete microphones arranged in a circular array,
- a processing system arranged to perform a first signal processing algorithm on sound originating from one or more of a first set of directions relative to said array to isolate a first sound source therein;
- wherein said processing system is arranged to perform a second signal processing algorithm on sound originating from one or more of a second set of directions relative to said array to isolate a second sound source therein.

Thus it will be seen by those skilled in the art that in accordance with the invention, different processing techniques are employed depending on the originating direction of the incoming sound. The Applicant has appreciated that by changing the signal processing applied to signals received from an array of microphones dependent on the orientation of the array relative to a direction of interest (e.g. to a particular sound source or to one of a range of directions during a sweep), a better response can be achieved than by using a single signal processing approach alone and that it may be possible to use a microphone array to capture sound accurately across a wide sound field, e.g. up to a 180° hemisphere or beyond.

In a set of embodiments the first processing algorithm comprises a broadside processing technique, e.g. constant directivity beamforming. The Applicant has appreciated that processing signals from a circular microphone array using constant directivity beamforming will typically give good results for signals emanating from directions up to approximately 60° from a perpendicular to the plane of the array.

Thus in a set of embodiments the first set of directions comprises directions up to a threshold angle from a perpendicular to the plane of the array. In a set of such embodiments the threshold angle is between 50° and 70°. The Applicant has further appreciated that beyond the threshold angle, the response achieved using broadside techniques such as constant directivity beamforming may not be acceptable. In accordance with the invention however sounds from the second set of directions, e.g. beyond the threshold angle, may be processed using a different algorithm.

The first and second sets of directions may be mutually exclusive, but this is not essential; a degree of overlap is envisaged as being possible for example. Sound in such an overlap region—e.g. emanating from both the first and second sets of directions could be processed by both algorithms with the results thereof compared using an appropriate metric or combined in a suitable manner.

It is further envisaged that a third signal processing algorithm may be performed on sound originating from one or more of a third set of directions relative to said array to isolate a third sound source therein.

In a set of embodiments the second processing algorithm comprises super-directive beamforming. The Applicant has appreciated that, when combined, super-directive beamformers and array geometries are suitable for remote speech acquisition, speech enhancement and acoustical imaging since they have the potential to achieve higher directivity than conventional beamformers without distorting the processed sound in the same way as adaptive beamformers do. Whether the goal is to improve speech intelligibility, provide a 'sharper' acoustical image, or detect and classify audio events in a challenging environment, the Applicant has appreciated that it is important not to introduce any artifacts to the output of the beamformer while removing the noise. Deterministic (non-adaptive) super-directive beamformers have the potential to discriminate noise (thereby providing greater directivity) better than can be achieved with arrays of the same size which use conventional beamformers. For some array geometries, typically oversampled arrays, broadside algorithms can made superdirective by the optimization of weights W applied to signals from respective microphones in the array. Whilst this may come at the cost of a decreased white noise gain ("WNG"), it may also reduce harmonic distortion and other artifacts that may pose a more challenging problem than a lower signal to noise ratio (SNR).

In the world of array research, super-directive beamformer theory has been rediscovered in recent years. The theory has been known for decades but has not been widely applied to microphone arrays in practice, due to the practical limitations of, for example, WNG. For circular arrays the theory, often referred to as Super-directive Phase Mode Processing, has a certain mathematical elegance. It provides a closed-form formula for the processing of the arrays with certain requirements to the size of the circular array and its sampling, giving a better response than what is given by conventional theory. However, the Applicant has appreciated that this is only true for sounds emanating from close to the plane of the circular array. Further away from this plane, an array designed by the standard rules may have quite poor performance, in terms of both directivity and WNG.

The Applicant's research has further concluded that to implement the broadside and end-fire operating modes most successfully in the same circular array the array should be designed and optimized with respect to the overall 3D-directivity. Whilst a spherical array (which can be considered a series of concentric circular arrays having spaced parallel planes) gives an enhanced 3D-directivity compared with one or more co-planar circular arrays, the latter is preferred for practical reasons such as transportation and unintrusiveness of the structure. The optimal circular array is a structure of co-planar concentric rings with varying sizes. The optimal radius of each ring, the number of microphones on each ring and the spacing between consecutive rings is a function of the operating range and the desired frequency.

In a set of embodiments the apparatus also comprises an orientation sensor.

As will be understood from the discussion above, in accordance with the invention the array may detect all incident sound, and individual beams processed by the optimal algorithm (e.g. broadside or endfire) depending on the beam's orientation relative to the array. To take an extreme example a beam orientated substantially radially with respect to the circular array may be processed using endfire processing techniques, whereas a beam orientated substantially parallel to axis of the circular array may be processed using broadside processing techniques. The orientation sensor may be used to classify or detect a sound source. The orientation sensor may also be used for providing a mapping of the audio signals into space.

However the Applicant has devised a further approach that can be used in some situations, especially where the approximate location of sound source is known. Accordingly in a set of embodiments the invention comprises using the orientation sensor to determine an orientation of the array and using said orientation to determine the first and second portions of sound. For example the orientation sensor could be used to determine if a device is on a table or on a wall thereby allowing a reasonable estimate of the incident direction of sound arising from speech by people sitting in the room. This may have several practical implications including: saving processing resources by only processing sound from directions it is feasible a sound source may be positioned; determining whether an array should be operated as a endfire or broadside array, or a combination of both; estimating the angular position of the array for co-referencing the operating area of the array with a map, a camera, or to combine with another array; determining whether a set of microphones are on the face or back of array.

Such arrangements are novel and inventive in their own right and thus when viewed from a second aspect the invention provides a device for capturing sound comprising:

- a support structure;
- a plurality of discrete microphones arranged on the support structure in a circular array; and
- an orientation sensor arranged to determine an orientation of the support structure.

Signals from the plurality of microphones could be transmitted for processing remotely; however in a set of embodiments processing is carried out in situ and thus the second aspect of the invention extends to a system for capturing sound comprising:

- a support structure;
- a plurality of discrete microphones arranged on the support structure in a circular array and arranged to provide a respective plurality of microphone signals;
- an orientation sensor arranged to provide an orientation signal indicative of an orientation of the support structure; and
- a processing subsystem arranged to receive said microphone signals and said orientation signal and to use said microphone signals and said orientation signal to determine a direction of an incoming sound relative to said orientation.

In a set of embodiments the processing subsystem is arranged to perform a first signal processing algorithm to isolate a first sound source if said direction is in one of a first set of directions and to perform a second signal processing algorithm to isolate a second sound source if said direction is in one of a second set of directions.

The optional and preferred features of the first aspect of the invention are optional and preferred features of this set of embodiments mentioned above.

In a set of embodiments the processing subsystem is arranged to apply differential weighting factors to said microphone signals for neighbouring microphone membranes which may optionally be orientated in different directions. This allows multiple microphone membranes closely clustered together to form a directional microphone whose directivity can be varied. This also allows for example signals from microphones which have vectors normal to their respective membranes with a closer alignment to the determined direction to be given a contributing weight than signals from those microphones which are less well aligned. In one example of this, microphones that are more well aligned could be given contributing weights and those less well aligned could be used as noise reference signals. This may improve the signal to interference ratio of the array.

In a set of embodiments the processing subsystem is arranged to filter out spatial noise according to respective algorithms designated for each of a plurality of noise directions.

In accordance with either aspect of the invention a single circular array could be provided but in a set of embodiments the device comprises a plurality of concentric circular arrays of microphones. In the Applicant's research it has been found that certain designs of circular microphone arrays (more details of which are provided hereinbelow) can improve the response even further, possibly in an entire three-dimensional space, while maintaining and even improving the white noise gain at the output of the array. This has been found to hold at least for circular arrays operating in the end-fire mode—that is using capturing sound approximately in the plane of the circular array. Array designs may be provided representing an optimal broadband end-fire circular array. When optimized for broadband applications, such an array may comprise an array of multiple concentric rings that can also be used as a broadband array.

In a subset of the embodiments outlined above the support structure comprises a corresponding plurality of discrete rings. The number of rings, the number of microphones N, and the size of the array may be decided by overall desired directivity and white noise gain of the array. In circular array theory, the directivity can be connected to the so-called excitation order of the Bessel functions that describe microphone signals when the microphones are arranged in an evenly sampled circular array. The spacing of the microphones, and the radius of the ring are preferably chosen so that the Bessel functions, and the phase modes which they describe, are correctly sampled in space, for example without aliasing. This is beneficial in order to ensure the phase modes have appreciable strength and do not require so much amplification in processing. Amplification, or higher weighting of the weak phase modes results in amplification of the noise at the output, and effectively decrease the white noise gain. The higher the order of the phase modes that can be represented with appreciable strength, the higher directivity achieved with the array.

In a set of embodiments of any aspect of the invention the radius of each concentric circular array is calculated by reference to the maximum phase mode order, M, the number of circular concentric arrays, P and the number of microphones in each concentric circular array, N, by equating the standard form of the frequency-weighted white noise gain to a form dependent on the aforementioned variables given by:

$$(2M+1)^2\left[\sum_{m=-M}^{m=M}\frac{1}{\sum_{p=0}^{P}N_p|J_m(kR_p)|^2}\right]^{-1}$$

In a sub-set of such embodiments this is maximised with respect to the aforementioned variables using a differential evolution algorithm.

In a set of embodiments of any aspect of the invention the limiting aperture of the concentric circular array is equal to $2\pi/k_1$, where $k_1$ is the smallest wavenumber the array is designed to detect.

In a set of embodiments of either or any aspect of the invention the diameter of the overall structure is in the range 5 cm to 50 cm.

In a set of embodiments of any aspect of the invention the number of circular ring arrays is in the range 1 to 20 e.g. 4 to 16, e.g. 8 to 12, e.g. 10.

In a set of embodiments a centre element is provided at the centre of the circular array(s). A single element could be provided or a plurality of essentially co-located elements could be provided.

In a set of embodiments of any aspect of the invention the maximum excited phase mode order for which the design is optimized is in the range 1 to 15 e.g. 4 to 10, e.g. 6 to 8, e.g. 7.

In a set of embodiments of any aspect of the invention the number of elements in each ring is in the range 1 to 40 e.g. 1 to 30, e.g. 1 to 21.

In a set of embodiments of any aspect of the invention, the ring with the smallest number of elements has between 1 and 21 elements e.g. between 5 and 5, e.g. 11

In a set of embodiments of any aspect of the invention ring with the highest number of elements has been 10 and 100 elements e.g. between 30 and 70, e.g. between 42 and 58 e.g. 50.

In a set of embodiments of any aspect of the invention the minimum element separation distance is in the range 2 to 15 mm e.g. 5 to 10 mm, e.g. 7.5 mm.

In a set of embodiments of any aspect of the invention the element spacing is less than or equal to half the wavelength of the highest frequency signal the array is designed to sample.

In one specific exemplary embodiment the support structure comprises 5 rings, having 11, 11, 11, 11, 83 elements respectively and an element in the centre.

In one specific exemplary embodiment the support structure comprises 9 rings, having 11, 15, 15, 15, 15, 15, 15, 15, 139 elements respectively and an element in the centre.

The microphones of the circular array(s) could be arranged with a specific angular distribution around the circle or respective circles to suit a specific application or environment, but in a preferred set of embodiments the microphones are arranged at equal angular spacings around the circular array(s).

The supporting structure of the array i.e. the ring(s) could be made from aluminium e.g. thin sheet or extruded aluminium, or from carbon fibre. In another set of embodiments, the rings are made from a flexible circuit board. In either case a flat sheet could be rolled to form an elongate tube which is then bent round to form a circle or part thereof (a complete circle may be formed from a plurality of partial circles).

The microphones could have any given orientation relative to a plane of the support structure or of the circular array. Notwithstanding the ability in accordance with some aspects of the invention to detect sounds accurately from a wide range of directions by using different processing algorithms, the microphones could, for example, be arranged so that they have vectors normal to their respective membranes oriented substantially radially with respect to the circular array e.g. to be optimised for a 'broadside' arrangement. Similarly the microphones could be arranged so that they have vectors normal to their respective membranes oriented substantially parallel to an axis of the circular array e.g. to be optimised for an 'end-fire' arrangement.

Where, as is preferred, multiple circular arrays mounted on one or several rings are provided, the microphones of the respective arrays could have the same orientations relative to the axis as each other. Alternatively they could differ. For example alternate arrays could be oriented axially and radially respectively.

In a set of embodiments the plurality of discrete microphones comprise a first array and said plurality of microphone signals comprise a plurality of first microphone signals, said system or device further comprising a second plurality of discrete microphones arranged on the support structure in a second circular array, concentric with the first circular array and arranged to provide a respective plurality of second microphone signals, wherein the first plurality of microphones are mounted so that they have vectors normal to their respective membranes oriented substantially radially with respect to the first circular array and the second plurality of microphones are mounted so that they have vectors normal to their respective membrane oriented substantially parallel to an axis of the second circular array.

Such an arrangement is considered to be novel and inventive in its own right and thus when viewed from a third aspect the invention provides a device for capturing sound comprising:

- a support structure;
- a first plurality of discrete microphones having respective membranes and arranged on the support structure in a first circular array;
- a second plurality of discrete microphones having respective membranes and arranged on the support structure in a second circular array concentric with the first circular array, wherein the first plurality of microphones are mounted so that they have vectors normal to their respective membranes oriented substantially radially with respect to the first circular array and the second plurality of microphones are mounted so that they have vectors normal to their respective membranes oriented substantially parallel to an axis of the second circular array.

In a set of embodiments the first plurality of discrete microphone and the second plurality of microphones are mounted on the same ring.

In a set of embodiment the second plurality of microphones are at the same angular positions on the circular array as the first plurality of microphones. Whilst a given pair of microphones from each of the first and second pluralities may have different directivities, in typical embodiments, the spatial separation of the microphones at the same circumferential position is very small relative to the wavelength of sound being captured such that they can be considered to have the same spatial position. The signals from these microphones may be combined, decreasing the self-noise.

In a preferred set of embodiments of the third aspect of the invention, the device comprises an orientation sensor arranged to determine an orientation of the support structure. This sensor may provide data helping to save processing resources etc as discussed in accordance with the first aspect of the invention.

In accordance with any aspect of the invention where it is provided, the orientation sensor, where provided may be selected from the group comprising a magnetometer, a gyroscope and an accelerometer.

It should be appreciated that where the term "substantially" is used herein to refer to an orientation, it is not essential that strict alignment with the specified direction is required. For example it is intended that an angle of up to +1-20 degrees to a direction would still be considered to be substantially parallel to that direction.

The Applicant has envisaged a set of embodiments in which the methods and arrangements as described above are implemented in devices for applications such as covert surveillance, video conferencing and detection and tracking of unmanned aerial vehicles (drones).

Certain embodiments of the present invention will now be described, by way of example only, with reference to the accompanying drawing in which.

Figure 6A:
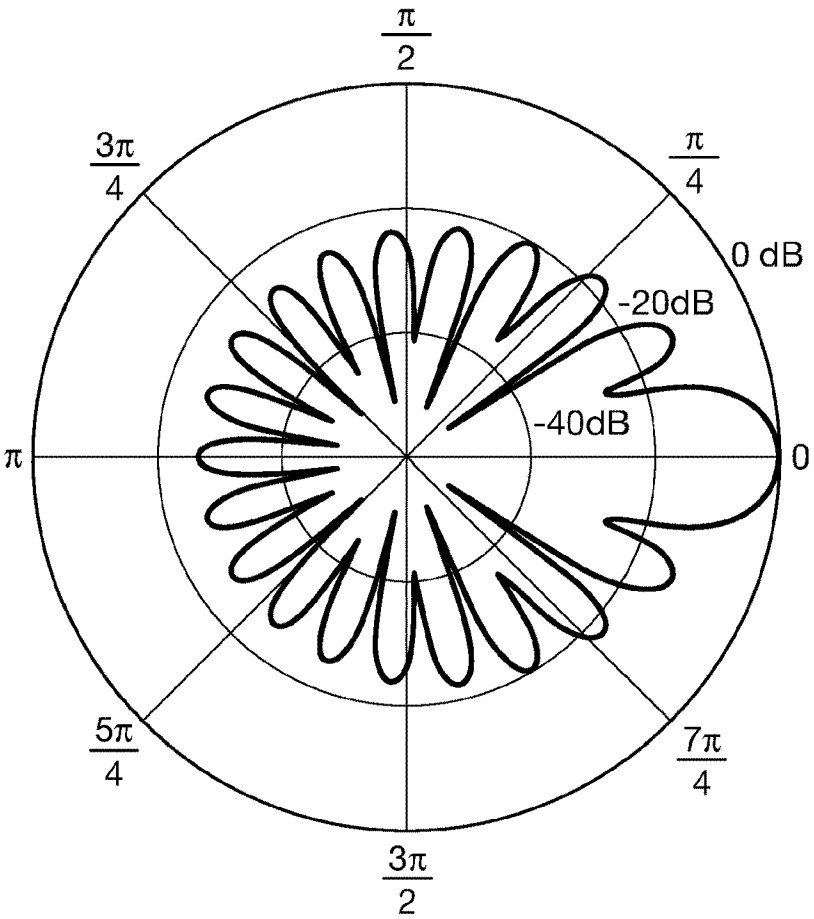
Figure 6B:
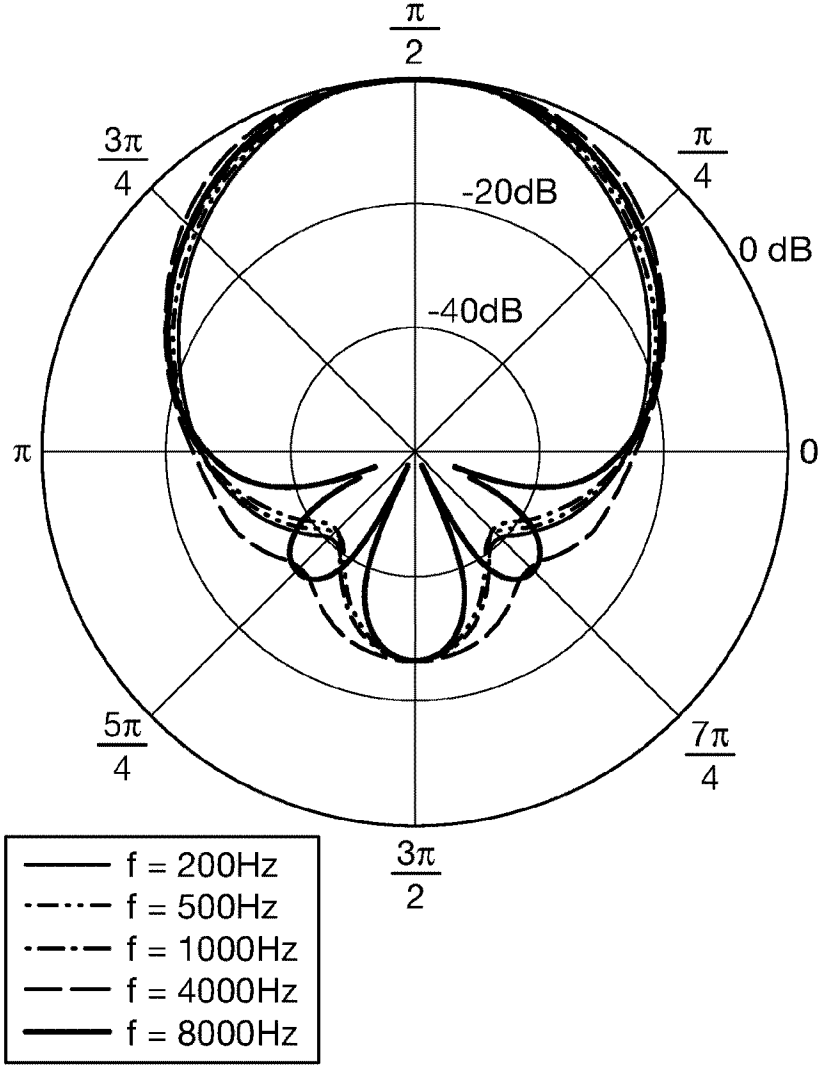

FIG. 6*a* shows an exemplary polar graph of the elevation cross-section of the power pattern for a singular ring array;

FIG. 6*b* shows an exemplary polar graph of the azimuth cross-section of the power pattern for a singular ring array.

Figure 7:
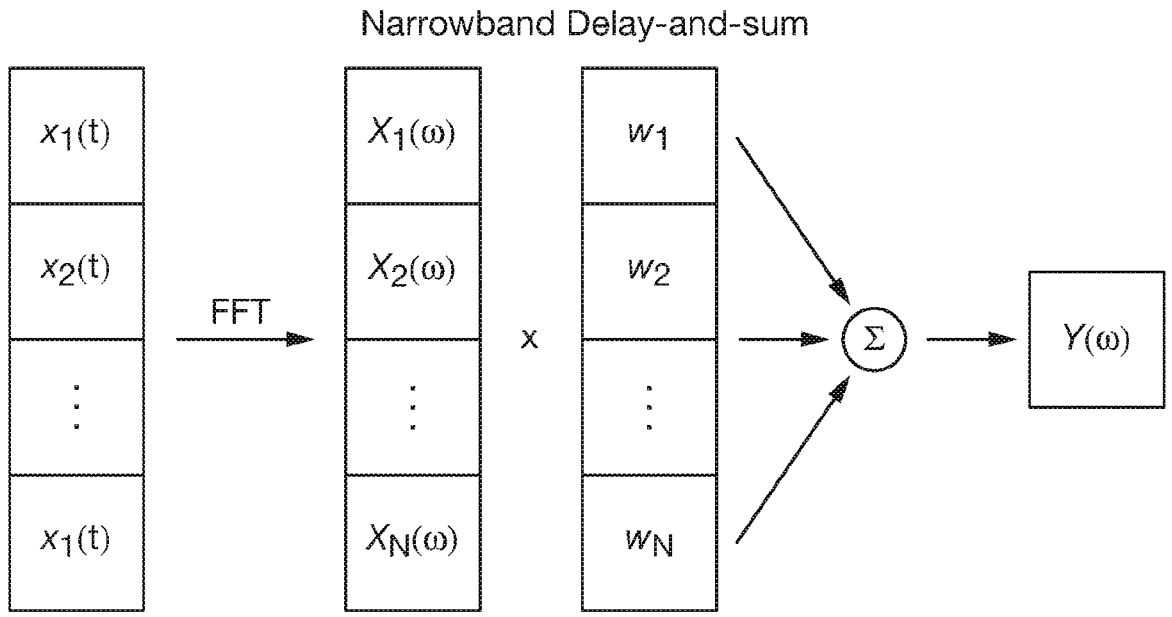

FIG. 7 shows the scheme by which beams corresponding to the broadside operating mode are processed.

Figure 8:
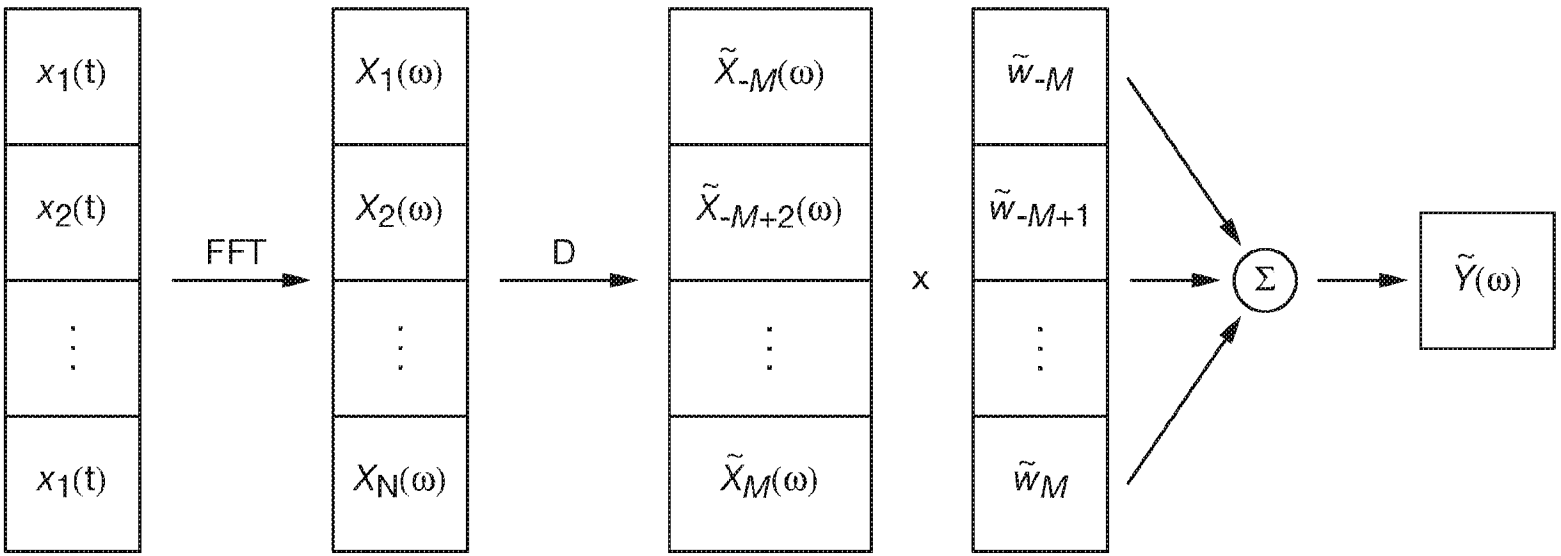

FIG. 8 shows the scheme by which beams corresponding to the endfire operating mode are processed.

Figure 9:
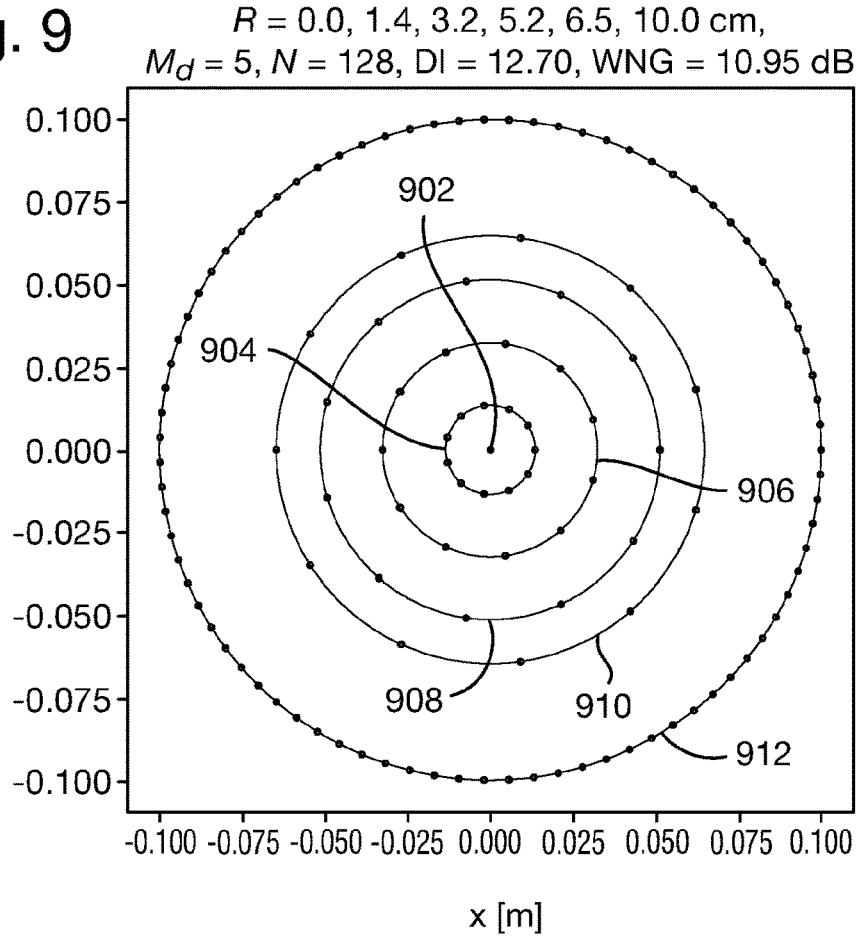

FIG. 9 shows an exemplary optimized array with an outermost ring of diameter 10 cm.

Figure 10:
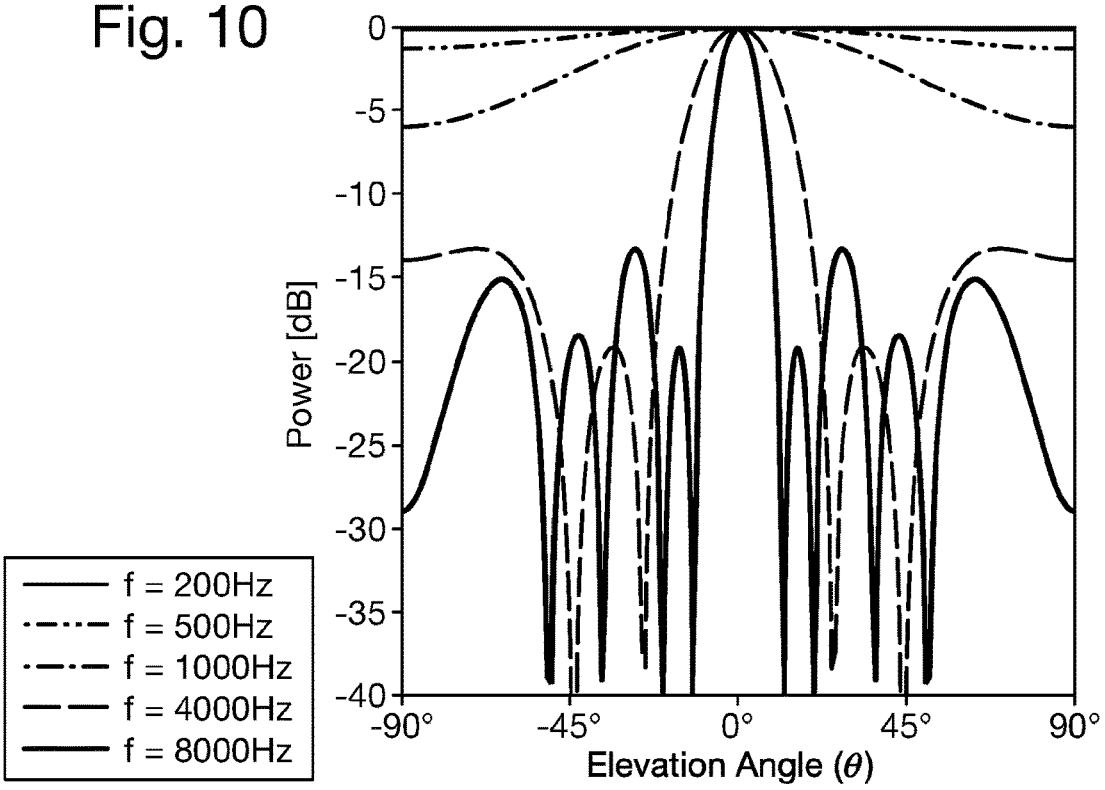

FIG. 10 shows the powerpattern produced by the exemplary array of FIG. 9 using broadside processing with uniform element weighting.

Figure 11:
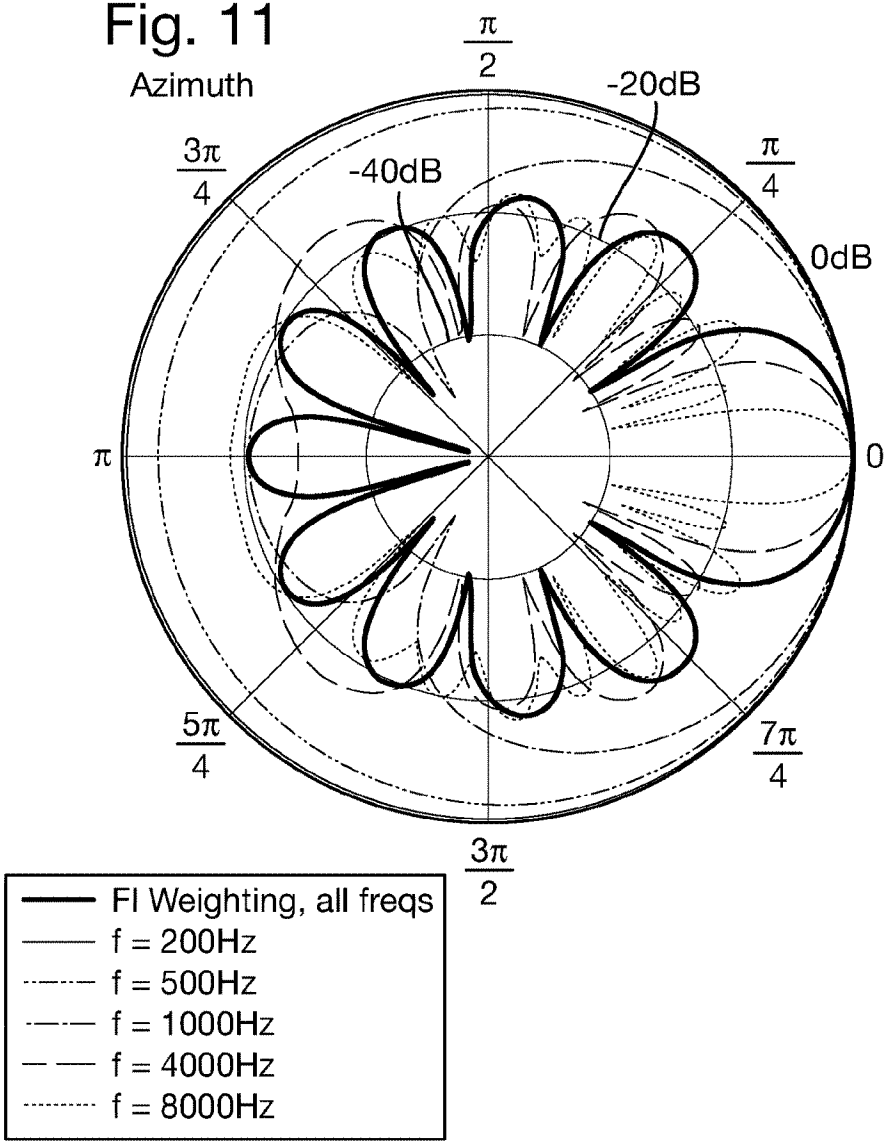

FIG. 11 shows the powerpatterns produced by the exemplary array of FIG. 9 across a complete range of angles of azimuth.

Figure 12:
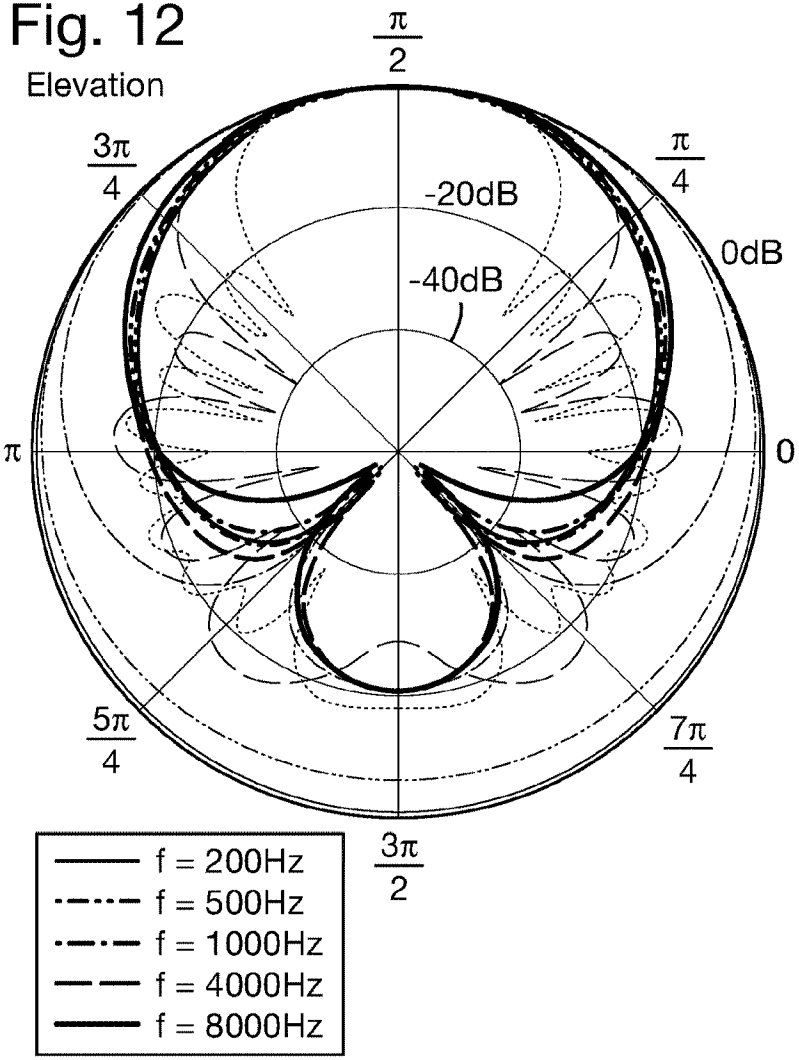

FIG. 12 shows the powerpatterns produced by the exemplary array of FIG. 9 across a complete range of angles of elevation.

Figure 13:
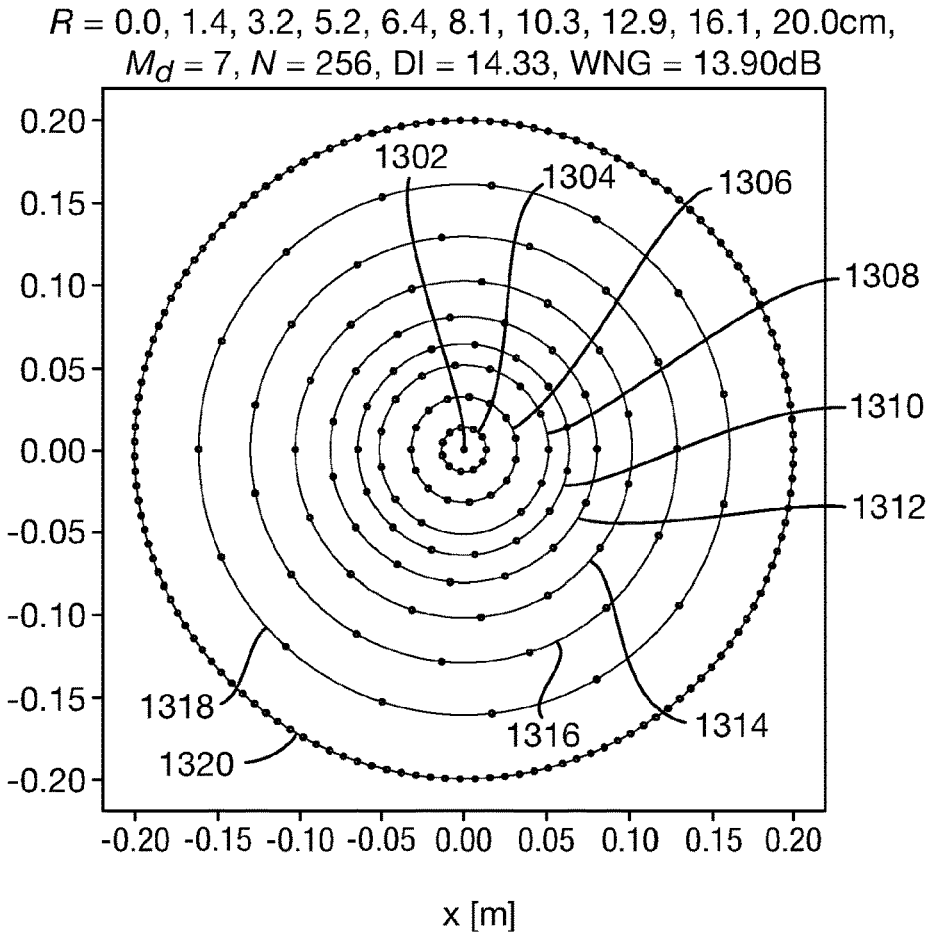

FIG. 13 shows an exemplary optimized array with an outermost ring of diameter 20 cm.

Figure 14:
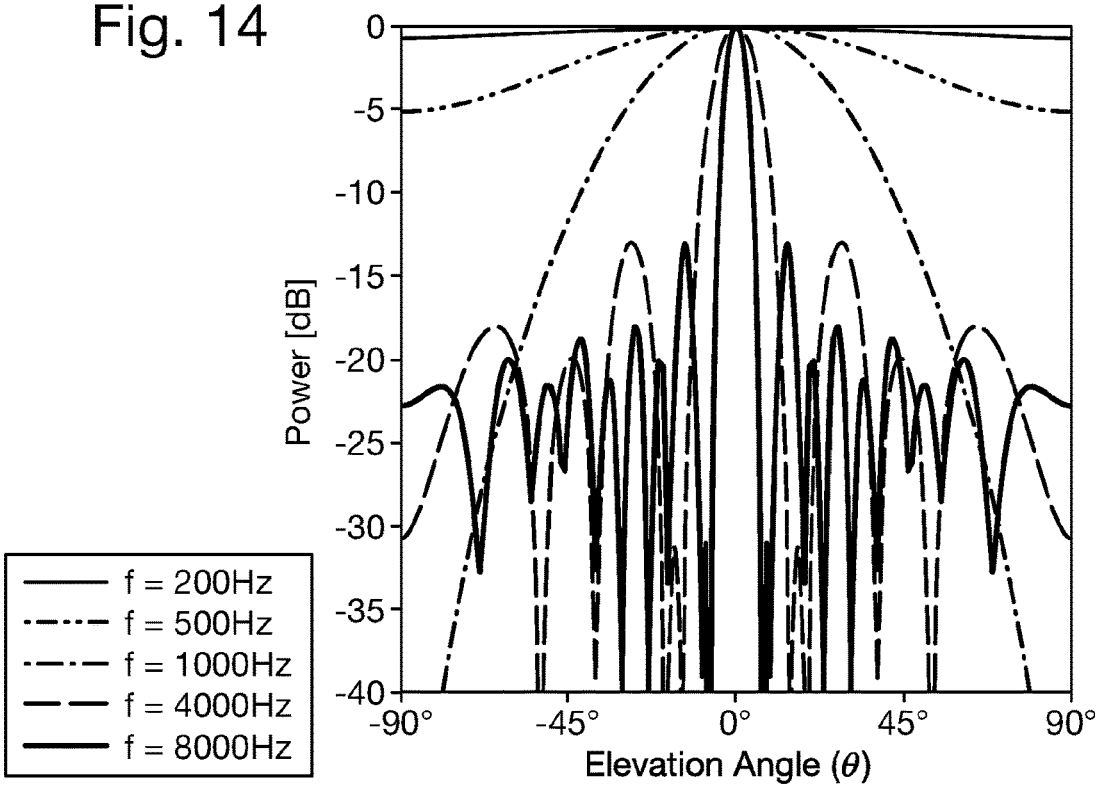

FIG. 14 shows the powerpattern produced by the exemplary array of FIG. 13 using broadside processing with uniform element weighting.

Figure 15:
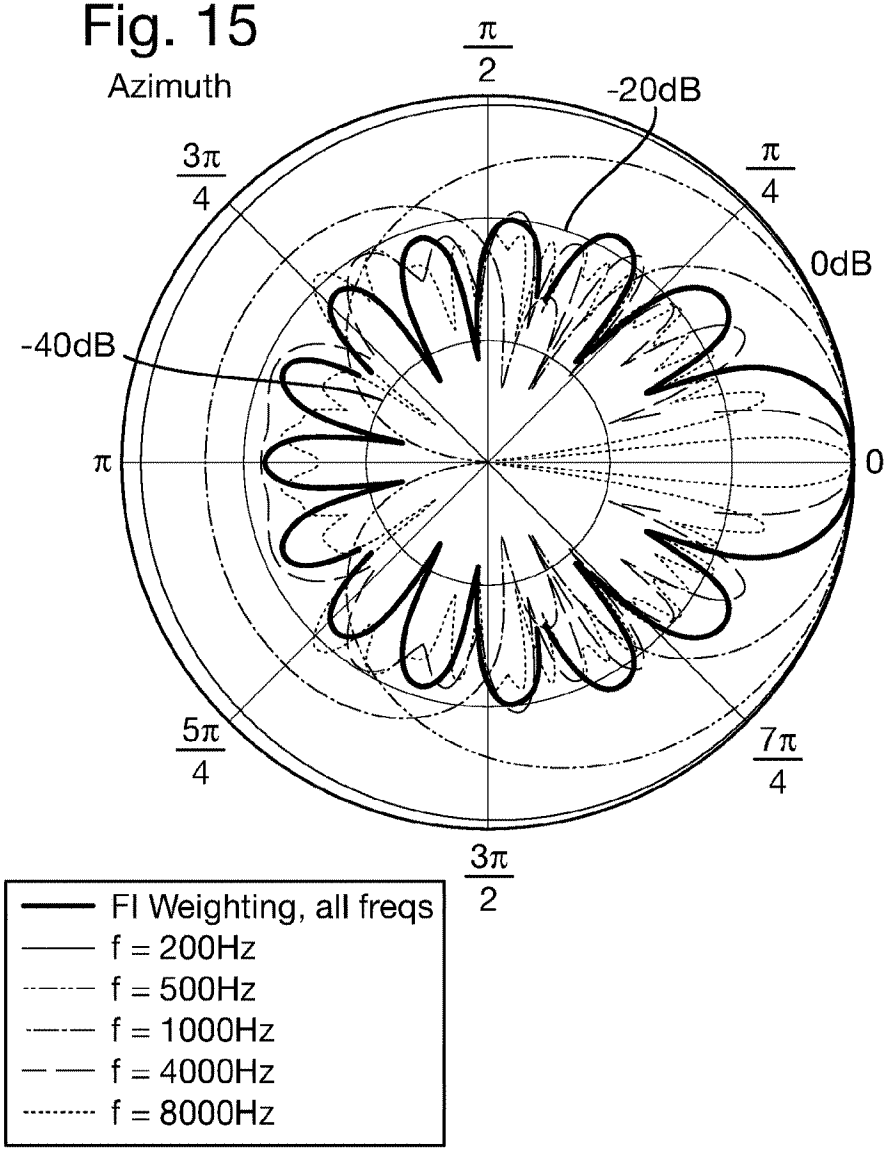

FIG. 15 shows the powerpatterns produced by the exemplary array of FIG. 13 across a complete range of angles of azimuth.

Figure 16:
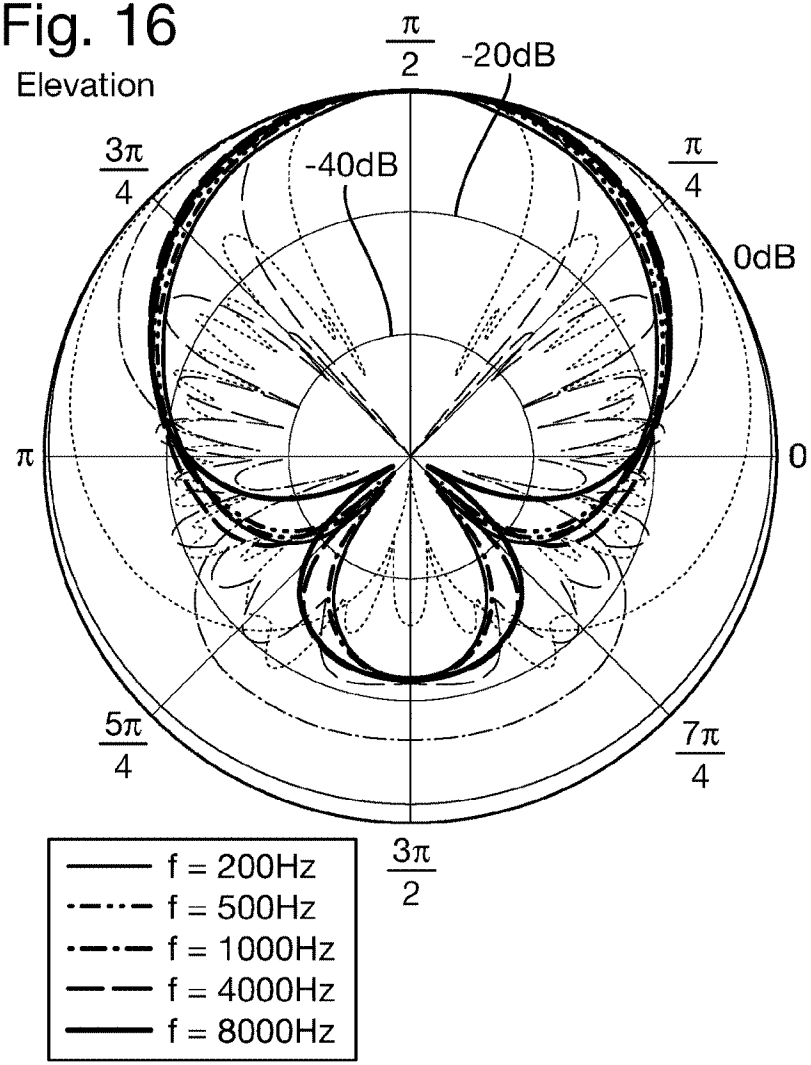

FIG. 16 shows the powerpatterns produced by the exemplary array of FIG. 13 across a complete range of angles of elevation.

Figure 1:
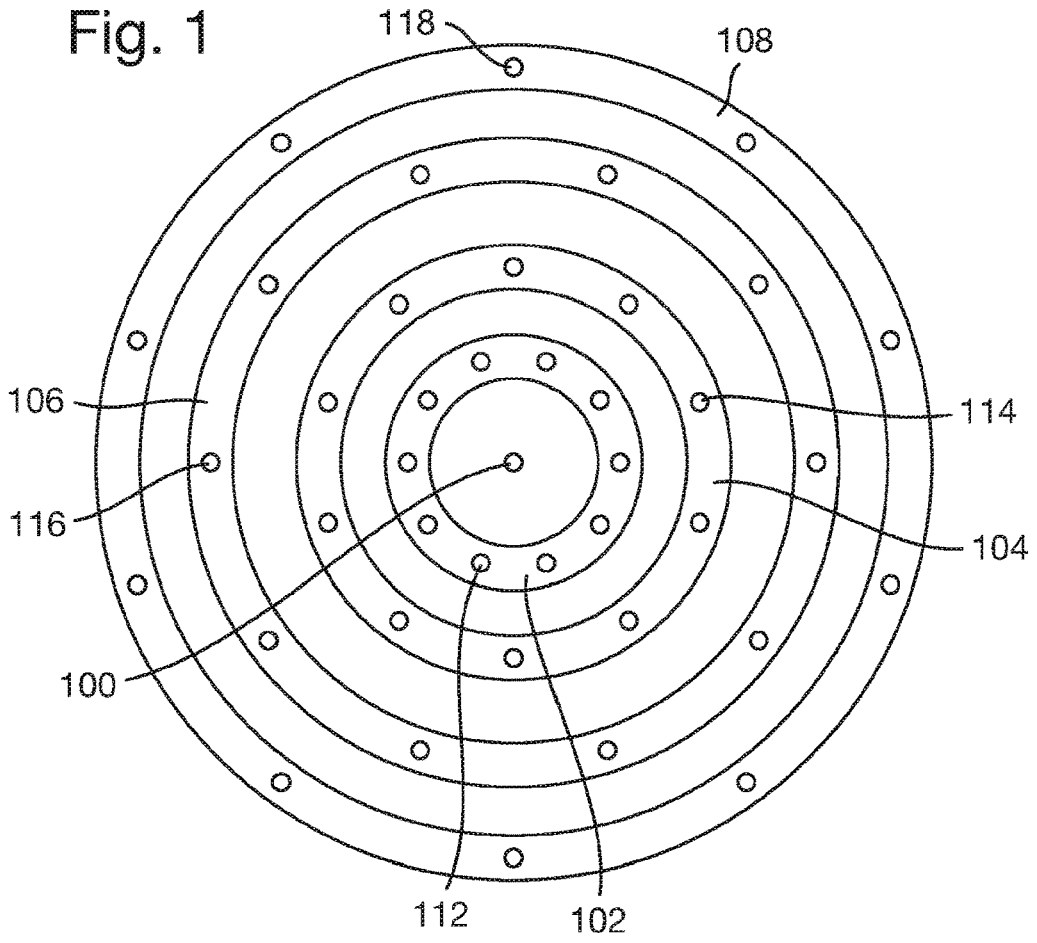
FIG. 1 is a schematic plan view of an embodiment of the invention with a multiple concentric ring support structure.

FIG. 1 is schematic plan view of a microphone array embodying the invention with a support structure comprising multiple concentric rings 102, 104, 106, 108 in which a corresponding plurality of microphones 112, 114, 116, 118 are embedded. An centre element 100 is located at the centre of the multiple concentric ring structure. In this Figure four rings are depicted, however the invention is not restricted to having four rings and any number could be provided. The Applicant has devised specific sets of desirable values of such parameters which produce unexpectedly good results which are described in more detail below. The number and dimensions of the rings and the number of microphones embedded may be varied depending on the application and the desired broadside response. The more rings utilized the higher the oversampling degree for broadside applications. The oversampling is utilized for super-directive weight optimization.

Figure 2:
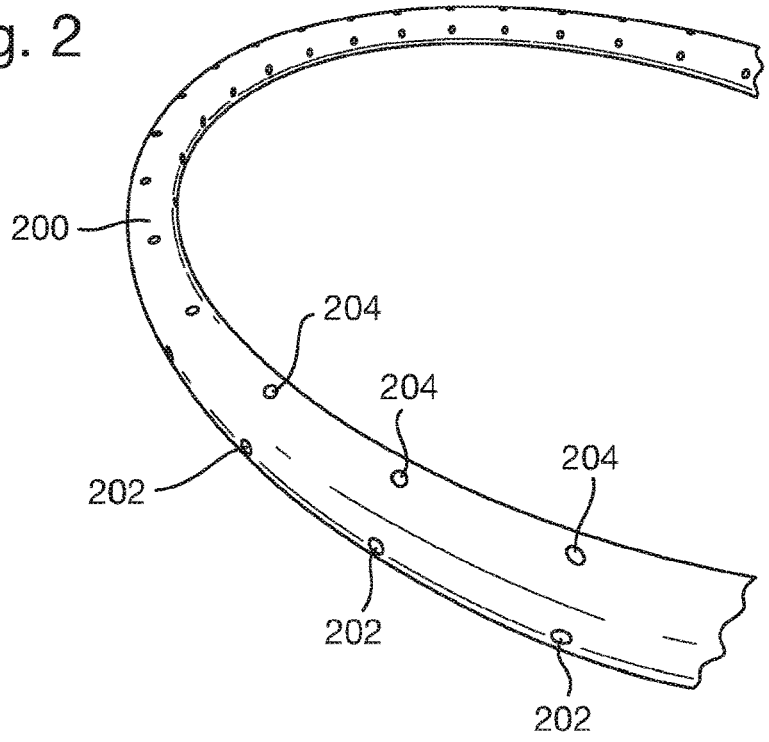
FIG. 2 is a perspective view of a single ring demonstrating a possible arrangement of first and second pluralities of microphones.
Figure 3:
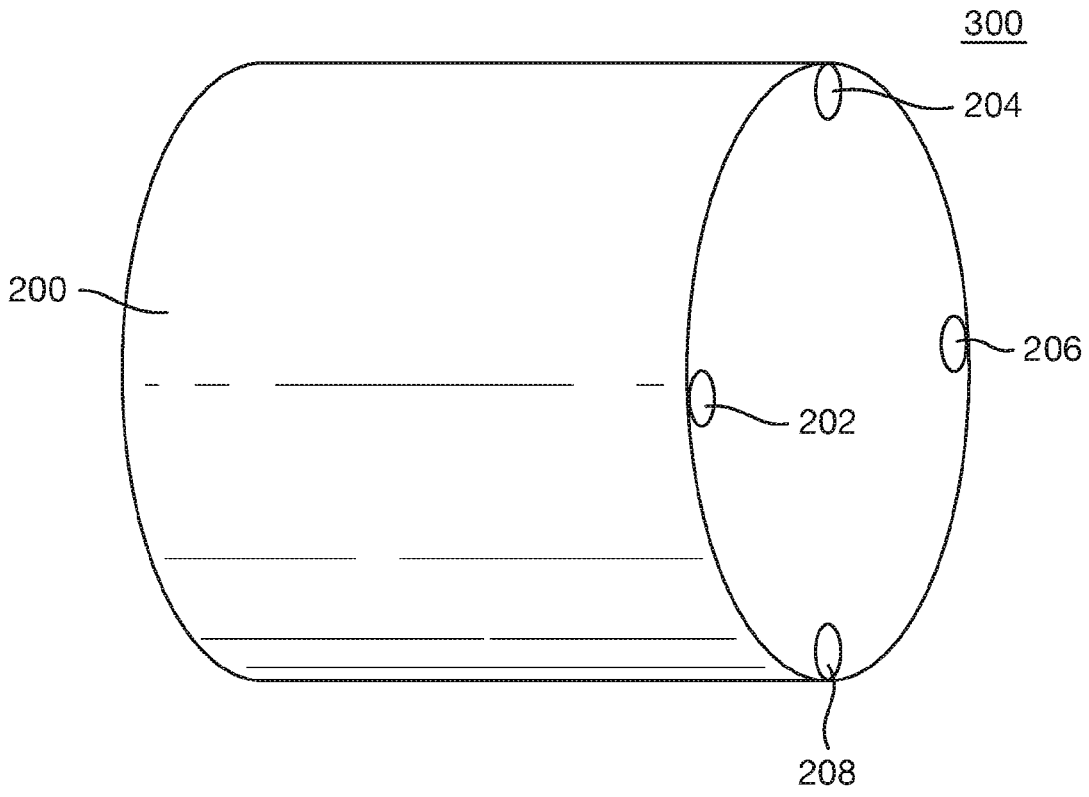
FIG. 3 shows a cross-section of a ring with multiple microphones at a given circumferential position.

The microphones may be miniature MEMS microphones which have low self-noise, allowing for improved phase and amplitude matching. As shown in FIGS. 2 and 3, multiple microphones may be implemented at a given angular location around the ring to further reduce self-noise below the typical value for a single miniature MEMS microphone of 30 dB, improving the accuracy of processed data.

The concentric rings may be formed from aluminium tubes. The radius of the overall structure may be for example 30 cm.

FIG. 2 shows in more detail a ring 200 which could be used in the embodiment described with reference to FIG. 1. Disposed on the ring 200 are a first plurality of microphones 202 having orientations so that vectors normal to their respective membranes are substantially radial with respect to the ring and a second plurality of microphones 204 have respective membrane normal vectors oriented substantially parallel to the central axis of the ring 200.

FIG. 3 illustrates in more detail a section of the tubular ring 200 forming part of the support structure. This shows the radially oriented microphone 202 and axially oriented microphone 204 at this circumferential location. In fact third and fourth microphones 206, 208 are also shown which are oriented in respective opposite directions to the first and second microphones 202, 204. Similar sets of four microphones are provided at regular spacings around the ring 200 as shown in FIG. 2.

By combining the signals from multiple microphones at each location around the circumference of the tube 200, the self-noise introduced by the individual microphones can be effectively reduced. Furthermore, it provides a wider range of angles over which high sensitivity can be achieved which facilitates use of the overall apparatus for isolating sound emanating from a wide field relative to the apparatus. Additionally, pair subsets of these four can simulate a directive element in the cross-sectional plane.

Figure 4:
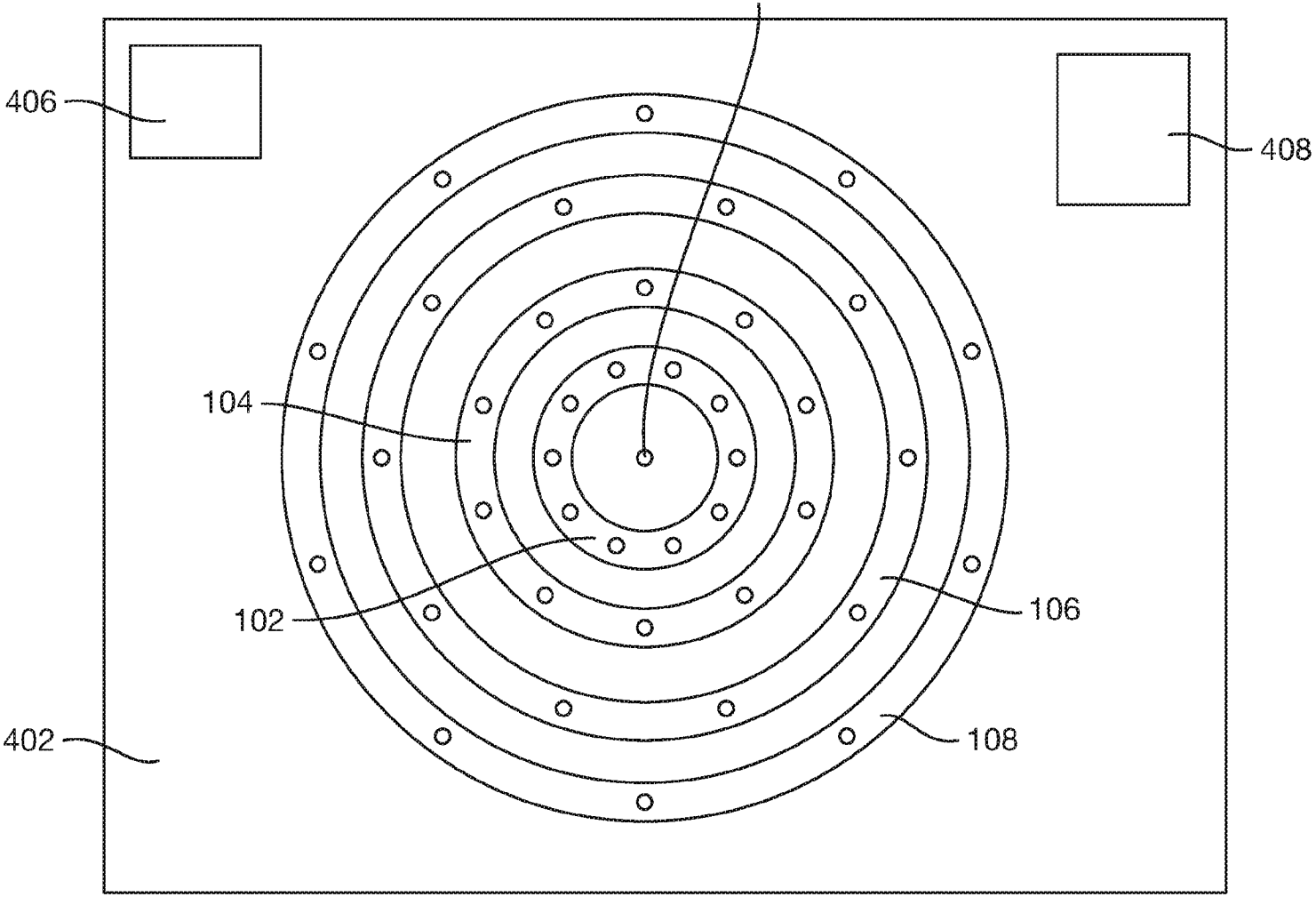
FIG. 4 shows schematically an embodiment of the invention including a mounting board.

FIG. 4 illustrates schematically an embodiment in the form of a sound capture device in which the multiple ring support structure 102, 104, 106, 108 of FIG. 1 is mounted to a backboard 402. This could be manufactured from plastic or aluminium for example. An centre element 100 is located at the centre of the multiple concentric ring structure. An orientation sensor 406 and a processing unit 408 are also affixed to, or incorporated within, the backboard 402. The sensor 406 could be e.g. a magnetometer, gyroscope and/or accelerometer or indeed any combination of these in any numbers. Multiple sensors may be used which can be distributed across the array structure.

The device may also comprise a camera (not shown). This can be used to assist in the determination of orientation (e.g. relative to a known image of its environment). It can also allow for visualisation of the environment on a remote device e.g. tablet, laptop. This is highly desirable for surveillance and video conferencing purposes. Furthermore it may enable remote control e.g. of the selection of the direction of the sound which is to be isolated. This may be used to steer the reception beam as is known per se and, together with the orientation sensor, to determine what processing algorithm to apply to the signals from the microphones (as is explained below).

Some embodiments of the device may require two-way data communication, therefore a receiver can be provided as well as the transmitter.

The processing unit 408 may perform all necessary processing of signals from the microphones but more typically controls transmission of data from these signals to a remote device allowing for storage and more powerful processing.

In certain embodiments, the combination of sensors and microphones allows beamforming using a single cluster of microphones on the array at a time i.e. the cluster with the best orientation. For example, some embodiments could use weighted combinations of clusters of microphones, or "backwards" facing microphones to eliminate background noise from the forward facing microphones.

For acoustic imaging purposes, the position of the device is measured using a number of sensors (including the orientation sensor 406) allowing all sound signals to be mapped to spatial positions, which can then be displayed on a remote screen allowing visualization. This technique is particularly advantageous in drone detection.

For surveillance purposes, the device could be realised as a camouflaged or disguised compact device. A wireless connection between the device and a remote receiver/transmitter allows the user to pinpoint the direction of interest or access the visualization obtained from the array. In embodiments where no camera or sensors are used, the orientation of the array may be predetermined and/or specified by a user to allow for the correct processing technique to be adopted.

In use of the device, signals from the microphones 112, 114, 116, 118; 202, 204, 206, 208 are processed using an appropriate algorithm. The algorithm is selected based on the direction from which the sound which it is desired to isolate is coming. As previously mentioned this could be established using any one or combination of: a visual interface to select the direction from a mapped image of the scene; the orientation sensor(s); or pre-programmed directions representing physical positions of the sources of interest.

The selection of algorithm is based on the direction in question relative to the central axis of the microphone array. This is the line passing though the centre or common centres of the rings 102, 104, 106, 108; 200 and normal to the planes of the rings (or the plane of the backboard 402). If the direction of sound is within a 60 degree forwardly-projected cone centred on the array central axis, broadside processing is used. If it outside this range, end-fire processing is used.

For the endfire processing mode the concept of the maximum excited phase mode may be understood as follows. The signals received at a set of N omni-directional microphones spaced evenly in a circle of radius R in a wavefield consisting of a single plane wave (given by $x(\vec{r},t)=Ae^{-i(\vec{k}\cdot\vec{r}+\omega t)}$) can be expressed, using the Jacobi-Anger expansion of complex exponentials of trigonometric functions, as $$X=\begin{bmatrix}X_0\\X_1\\\vdots\\X_{N-1}\end{bmatrix}=A\begin{bmatrix}e^{ikR\sin\theta\cos\left(\varphi-\frac{2\pi}{N}\cdot 0\right)}\\e^{ikR\sin\theta\cos\left(\varphi-\frac{2\pi}{N}\cdot 1\right)}\\\vdots\\e^{ikR\sin\theta\cos\left(\varphi-\frac{2\pi}{N}\cdot(N-1)\right)}\end{bmatrix}e^{-i\omega t}$$

$$=A\begin{bmatrix}\sum_{m=-\infty}^{\infty}i^mJ_m(kR\sin\theta)e^{im\left(\varphi-\frac{2\pi}{N}\cdot 0\right)}\\\sum_{m=-\infty}^{\infty}i^mJ_m(kR\sin\theta)e^{im\left(\varphi-\frac{2\pi}{N}\cdot 1\right)}\\\vdots\\\sum_{m=-\infty}^{\infty}i^mJ_m(kR\sin\theta)e^{im\left(\varphi-\frac{2\pi}{N}\cdot(N-1)\right)}\end{bmatrix}e^{-i\omega t}$$

$$\approx A\begin{bmatrix}\sum_{m=-\infty}^{M}i^mJ_m(kR\sin\theta)e^{im\left(\varphi-\frac{2\pi}{N}\cdot 0\right)}\\\sum_{m=-\infty}^{M}i^mJ_m(kR\sin\theta)e^{im\left(\varphi-\frac{2\pi}{N}\cdot 1\right)}\\\vdots\\\sum_{m=-\infty}^{M}i^mJ_m(kR\sin\theta)e^{im\left(\varphi-\frac{2\pi}{N}\cdot(N-1)\right)}\end{bmatrix}e^{-i\omega t},$$

Where $J_m$ is the order m Bessel function of the first kind, and $k=\omega/c$ is the wavenumber of the wavefield with frequency co and propagation speed c. The wavevector is given by $\vec{k}=-k(\sin\theta\cos\phi, \sin\theta\sin\phi, \cos\theta)$, with the minus sign introduced for later convenience. N is the number of microphones in the array. The Bessel function order M that the Jacobi-Anger expansion is truncated at is referred to as the maximum excited phase mode order in the context of circular array theory.

The processing of the array (both in the endfire and broadside processing modes) is done in such a manner that a Fast Fourier Transform (FFT) in applied to the data from all the microphones in the array. The beams corresponding to the broadside operational mode are processed according to the scheme presented in FIG. 7, while endfire beams are processed as in FIG. 8. In both cases the beamforming in the frequency domain is executed according to:

$$Y(\omega)=W(\omega)^HX(\omega). \tag{1}$$

Where $W(\omega)$ is the weighting vector corresponding to frequency $\omega$, $X(\omega)$ is the frequency domain vector corresponding to frequency $\omega$ and $Y(\omega)$ is the weighted frequency domain corresponding to $\omega$. This process is done once per direction, corresponding to one beam. The expression above is provided for narrowband cases. It can be generalized for any band-width by repeating the processes for each frequency bin and by summing the contributions. If the time-domain signal is the preferable output, the inverse Fourier transform is applied.

For broadside beams, the weights W are applied to frequency data vector $X=[X_1, X_2, \ldots, X_N]^T$ of dimension N×1. The weight vector $W(\omega)=[w_1(\omega), w_2(\omega), \ldots, w_N(\omega)]^T$ is also N×1, where index n denotes a particular microphone, $w_n$ is the weighting applied to microphone n, and $X_n(\omega)$ is the frequency domain data from the microphone n. The weight vector can be changed according to the application and the desired response of the array. In a preferable embodiment $W(\omega)$ will be estimated by using the least squares weight optimization. The constraints for the optimization will depend on the desired response, and are chosen for example to yield a super-directional response, minimum side-lobe level, or constant directivity. What is achievable via optimization is decided by the geometry of the array. For example, super-directivity at a frequency $\omega$ is only possible if the array rings and the microphones on the rings are spaced closer than a half wavelength. The output Y is a scalar value of dimension 1×1.

In the end-fire operating mode, phase mode processing is used, as shown in FIG. 8 for a single ring of N elements. After the Fourier transform that brings each microphone's signal to frequency domain, the signals from each microphone are transformed to the phase mode domain via a spatial discrete Fourier transform according to the equation $$\tilde{X}=\begin{bmatrix}\tilde{X}_{-M}(\omega)\\\tilde{X}_{-M+1}(\omega)\\\vdots\\\tilde{X}_M(\omega)\end{bmatrix}=$$

$$\mathcal{D}X=\frac{1}{\sqrt{N}}\begin{bmatrix}e^{i\frac{2\pi}{N}\cdot(-M)\cdot 1} & e^{i\frac{2\pi}{N}\cdot(-M)\cdot 2} & \ldots & e^{i\frac{2\pi}{N}\cdot(-M)\cdot N}\\e^{i\frac{2\pi}{N}\cdot(-M+1)\cdot 1} & e^{i\frac{2\pi}{N}\cdot(-M+1)\cdot 2} & \ldots & e^{i\frac{2\pi}{N}\cdot(-M+1)\cdot N}\\\vdots & \vdots & \ddots & \vdots\\e^{i\frac{2\pi}{N}\cdot M\cdot 1} & e^{i\frac{2\pi}{N}\cdot M\cdot 2} & \ldots & e^{i\frac{2\pi}{N}\cdot M\cdot N}\end{bmatrix}\begin{bmatrix}X_1(\omega)\\X_2(\omega)\\\vdots\\X_N(\omega)\end{bmatrix},$$

where $\tilde{X}$ denotes the phase domain signals. The individual phase mode signals are then weighted and summed to produce an output signal $\tilde{Y}$, analogously to Eq. (1): $\tilde{Y}=\tilde{W}^H\tilde{X}$. This processing scheme is shown in FIG. 8. The phase mode weightings used are of the standard frequency-invariant form, given by $$\tilde{W}=[\tilde{w}_{-M}(\omega), \tilde{w}_{-M+1}(\omega), \ldots, \tilde{w}_M(\omega)]^T \tag{2}$$

$$\tilde{w}_m(\omega)=\frac{h_m}{\sqrt{N}\,J_m(kR\sin\theta')e^{im\phi'}},$$

when the array is steered to the direction $(\theta', \phi')$. The auxiliary phase mode weights $h_m$ can be used to shape the beampattern. When multiple rings are used, the signals from each microphone signals transformed to the phase mode domain in each ring individually. The resulting signals are then weighted and summed over both rings and phase modes:

$$Y=\sum_{m=-M}^{M}\sum_{p=0}^{P}\tilde{w}_{m,p}\tilde{X}_{m,p},$$

where the phase mode weights are given by $$\tilde{w}_{m,p}=\frac{h_m v_{m,p}}{\sqrt{N_p}\,J_m(kR_p\sin\theta')e^{im\phi'}}, \tag{3}$$

-continued $$v_{m,p} = \begin{cases} \dfrac{N_p|J_m(kR_p)|^2}{\sum_{q=0}^{P_m} N_q|J_m(kR_q)|^2} & \text{if } 1 \le p \le P_m, \\ 0 & \text{otherwise.} \end{cases} \quad (4)$$

$P_m$ denotes the index of the largest ring (equivalent to the number of rings) included in the sampling of a given phase mode m at a given frequency and is given by $$P_m = |\{R_q | 1 \le q \le P, kR_q < m+1\}|.$$

This particular form of the weights has been found to yield nearly optimal WNG for a given set of radii (fully optimal when $P_m$=P ∀m), while at the same time being flexible in terms of allowing a large range of radii without violating the assumptions that underlie phase mode processing. The WNG using this processing scheme is given by $$WNG = \left[ \sum_{m=-M}^{M} \frac{h_m}{\sum_{p=0}^{P_m} N_p|J_m(kR_p)|^2} \right]^{-1}. \quad (5)$$

The ring radii are derived from maximising the WNG, with the constraints of M, the number of the discrete ring support structures, P, and the number of microphones on each discrete ring support structure, $N_p$.

Therefore the number of microphones in each ring, the limiting aperture and the radius of each discrete ring may each be optimised.

For wideband signals, e.g. speech, the array input is decomposed via FFT and each frequency bin component is processed as a narrowband signal as described above. When designing an array for wideband frequency acquisition it is desirable to weight the WNG at different frequencies against one another. Optimizing a weighted average WNG over the frequency bands of interest may result in an array with particularly low WNG at low frequencies. Therefore a weighted log-average WNG is used in this example, as given by:

$$WNG = \sum_{i=1}^{I} g(f_i) \log \left[ \sum_{\gamma\gamma t=-M}^{M} \frac{h_m}{\sum_{p=0}^{P_{i,m}} N_p|J_m(k_i R_p)|^2} \right]^{-1}. \quad (6)$$

where g(f) represents a frequency weighting function e.g. for speech acquisition frequency bands are weighted by their relative importance to intelligibility, such as given by the Speech Intelligibility Index (SII). Using SII weighting as a criterion yields the upper frequency $f_1$=8 kHz.

One of the primary parameters of the array design is the radius of the largest ring $R_p$. From a signal processing perspective, a large as possible aperture is desirable, thus the largest radius is limited by practical considerations of the physical size of the microphone array and support structure. For example let the physical restraints determine that $R_P$=0.20 m. The smallest non-zero radius is constrained by $$R_1 < \frac{c}{\pi f_{max}} = 2.7 \text{ cm}$$

in order to ensure that at least one phase mode can be sampled without modal aliasing for the highest frequency for which the array has been designed $f_{max}$, where the speed of sound is denoted by c. The maximum excited phase mode order, M, is a parameter that may be varied in processing, but since the ring radii are determined by maximizing Eq. (6), a particular value $M_d$ is chosen for which the design is optimized.

The number of rings, P, is indirectly determined by the optimization procedure, though an upper bound may be set based on the desired number of elements in the array, and the design phase mode order, $M_d$. For e.g. $M_d$=7 the required number of elements per ring is 15, and with a cap of 256 elements in total (due to processing restrictions, for instance) this yields a maximum of 17 rings. An array optimised according to Eq. (6) tends to have fewer rings, and more elements in the largest ring.

Figure 5:
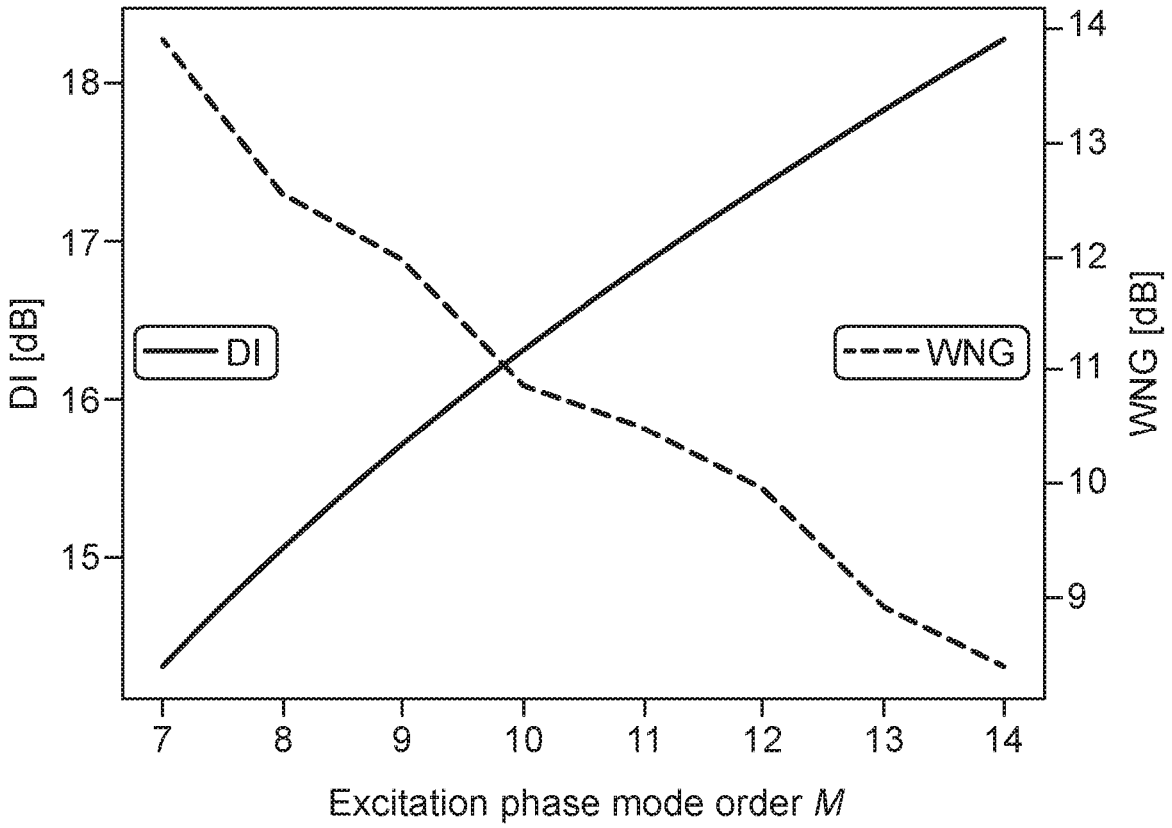
FIG. 5 shows a graph of directivity and WNG as a function of excitation mode order for an optimised array.

The effects of varying M in the processing are demonstrated in FIG. 5. Directivity (DI) and WNG are plotted as a function of the phase mode excitation for a multiple ring support structure, designed for $M_d$=P=7, using the previously discussed optimization. Exciting the array with higher order phase modes shows a steady increase in DI and an unevenly decreasing WNG. To sample a given phase mode M with negligible modal aliasing in a given ring array requires at least 2M+1 elements. It is therefore useful to design the array for the highest phase order that will be used in processing.

A lower maximal phase order may then be used in processing in order to boost WNG at the expense of DI. However, practical restrictions on the minimum element spacing may make it difficult to sample the highest phase modes from the innermost ring arrays.

In a specific embodiment where $R_p$=0.10 cm, N=128 and $M_d$=5 the minimum element distance is 7.5 mm giving an upper bound of P=11 rings. Maximising Equation 6 using SII frequency weighting yields an array as seen in FIG. 9. This optimization in particular yields an array where the three rings with the largest radii all have diameters equal to the maximum aperture, thus P is effectively equal to 5 due to merging of these rings. Furthermore, to offset the poor WNG at low frequencies, additional elements are added to the outermost ring, brining the total number of elements to 128. This array has a singular centre element, 11 elements in rings 1 through to 4, and 83 elements in ring 5.

FIGS. 6*a* and 6*b* illustrate the power pattern across a complete range of angles of azimuth and elevation respectively for an array of concentric rings having the parameters mentioned above and steered to θ=90°, ϕ=ϕ°, and for a selection of SII band centre frequencies.

Different frequencies are represented in different line styles. The narrowing of the beam increases the directivity and hence spatial resolution of the array.

FIG. 9 shows the design of the arrangement of rings and elements for an optimized array in accordance with the invention with a maximum aperture of 10 cm. The maximum excited phase mode order for which the design is optimized is $M_d$=5. The array includes a singular centre element 902, and five rings 904, 906, 908, 910, 912. The radius of the innermost ring 904 is 1.4 cm, the second ring 906 is 3.2 cm, the third ring 908 is 5.2 cm, the fourth ring 910 is 6.5 cm and the outermost ring 912 is 10 cm. The total number of elements in the array is 128.

FIG. 10 demonstrates the powerpattern produced using broadside processing with the array shown in FIG. 9.

FIGS. 11 and 12 illustrate the powerpatterns across a complete range of angles of azimuth and elevation respectively for an array as described in FIG. 9. The powerpattern associated with different frequencies are shown in different line styles.

In FIG. 11 line style corresponds to a specific frequency processed with the conventional beamformer. The black solid line represents the frequency invariant weighting which results in identical powerpatterns for all frequencies.

In FIG. 12 each line style corresponds to a specific frequency processed with the optimal phase mode algorithm (thicker line styles) and the conventional beamformer (thinner line styles).

FIG. 13 shows the design of the arrangement of rings and elements for an optimized array in accordance with the invention with a maximum aperture of 20 cm. The maximum excited phase mode order for which the design is optimized is $M_d$=7. The array includes a singular centre element 1302, and nine rings 1304, 1306, 1308, 1310, 1312, 1314, 1316, 1318, 1320. The radius of the innermost ring 1304 is 1.4 cm, the second ring 1306 is 3.2 cm, the third ring 1308 is 5.2 cm, the fourth ring 1310 is 6.4 cm, the fifth ring 1312 is 8.1 cm, the sixth ring 1314 is 10.3 cm, the seventh ring 1316 is 12.9 cm, the eighth ring 1318 is 16.1 cm and the outermost ring 1320 is 20 cm. The total number of elements in the array is 256.

FIG. 14 demonstrates the powerpattern produced using broadside processing with the array shown in FIG. 13.

FIGS. 15 and 16 illustrate the powerpatterns across a complete range of angles of azimuth and elevation respectively for an array as described in FIG. 13. The powerpattern associated with different frequencies are shown in different line styles.

In FIG. 15 each colour corresponds to a specific frequency processed with the conventional beamformer (dashed line styles). The black solid line represents the frequency invariant weighting which results in identical powerpatterns for all frequencies.

In FIG. 16 each line styles corresponds to a specific frequency processed with the optimal phase mode algorithm (thicker line styles) and the conventional beamformer (thinner line styles).

The invention claimed is:

1. A method comprising:

receiving sound at a plurality of discrete microphones arranged in a circular array, at least some of said microphones producing signals in response to said sound, performing a first signal processing algorithm comprising a broadside processing technique on sound originating from one or more of a first set of directions relative to said array to isolate a first sound source located within the first set of directions; and performing a second signal processing algorithm comprising an end-fire processing technique on sound originating from one or more of a second set of directions relative to said array to isolate a second sound source located within the second set of directions;

wherein the second sound source is separate from the first sound source;

wherein the first set of directions comprises directions up to a threshold angle from a perpendicular to the plane of the array.

2. The method as claimed in claim 1 wherein the threshold angle is between 50° and 70°.

3. The method as claimed in claim 1 wherein the second processing algorithm comprises super-directive beamforming.

4. The method as claimed in claim 1 further comprising using an orientation sensor to determine an orientation of the array and using said orientation to determine an first and second portions of sound.

5. The method as claimed in claim 1 comprising receiving sound at a plurality of discrete microphones arranged in a plurality of concentric circular arrays.

6. The method as claimed in claim 5 wherein a radius of each concentric circular array is calculated by reference to a maximum phase mode order, M, the number of circular concentric arrays, P and a number of microphones in each concentric circular array, N, by equating the standard form of the frequency-weighted white noise gain to a form dependent on the aforementioned variables given by:

$$(2M+1)^2\left[\sum_{m=-M}^{m=M}\frac{1}{\sum_{p=0}^{P}N_p|J_m(kR_p)|^2}\right]^{-1}.$$

7. The method as claimed in claim 1, further comprising using one or more cameras to determine an orientation of the array and to determine whether to apply the first or the second signal processing algorithm to the signals from the plurality of discrete microphones.

8. A system for capturing sound comprising:

a plurality of discrete microphones arranged in a circular array, a processing system arranged to perform a first signal processing algorithm comprising a broadside processing technique on sound originating from one or more of a first set of directions relative to said array to isolate a first sound source located within the first set of directions;

wherein said processing system is arranged to perform a second signal processing algorithm comprising an end-fire processing technique on sound originating from one or more of a second set of directions relative to said array to isolate a second sound source located within the second set of directions;

wherein the second sound source is separate from the first sound source wherein the first set of directions comprises directions up to a threshold angle from a perpendicular to the plane of the array.

9. The system as claimed in claim 8, further comprising a support structure.

10. The system as claimed in claim 9, wherein the plurality of discrete microphones comprise a first array and said plurality of microphone signals comprise a plurality of first microphone signals, said system further comprising a second plurality of discrete microphones arranged on the support structure in a second circular array, concentric with the first circular array and arranged to provide a respective plurality of second microphone signals, wherein the first plurality of microphones are mounted so that they have vectors normal to their respective membranes oriented substantially radially with respect to the first circular array and the second plurality of microphones are mounted so that they have vectors normal to their respective membrane oriented substantially parallel to an axis of the second circular array.

11. The system as claimed in claim 8, wherein the processing subsystem is arranged to filter out spatial noise according to respective algorithms designated for each of a plurality of noise directions.

12. The system as claimed in claim 8, comprising a plurality of concentric circular arrays of microphones.

13. The system as claimed in claim 8, wherein a limiting aperture of the concentric circular arrays is equal to $2\pi/k_1$, where $k_1$ is a smallest wavenumber the array is designed to detect.

14. The system as claimed in claim 8 comprising a centre microphone(s) at a centre of the circular array(s).

15. The system as claimed in claim 8, wherein a maximum excited phase mode order for which the system is optimized is in the range 1 to 15.

16. The system as claimed in claim 8 wherein said microphones have a spacing less than or equal to half a wavelength of a highest frequency signal the array is designed to sample.

17. The system as claimed in claim 8 wherein the microphones are arranged at equal angular spacings around the circular array(s).

18. The system or device as claimed in claim 8, wherein the first plurality of discrete microphone and the second plurality of microphones are mounted on a common ring.

19. The system or device as claimed in claim 8, wherein the second plurality of microphones are at the same angular positions on the circular array as the first plurality of microphones.

20. The system as claimed in claim 8, further comprising one or more cameras configured to generate images, wherein the processing system is arranged to use the images to determine an orientation of the array and to determine whether to apply the first or the second signal processing algorithm to the signals from the plurality of discrete microphones.

* * * * *